US010485088B1

(12) United States Patent
Hassan et al.

(10) Patent No.: US 10,485,088 B1
(45) Date of Patent: Nov. 19, 2019

(54) RADIO FREQUENCY TUNING OF DRESSED MULTICELL CAVITIES USING PRESSURIZED BALLOONS

(71) Applicant: Fermi Research Alliance, LLC, Batavia, IL (US)

(72) Inventors: Mohamed Awida Hassan, Aurora, IL (US); Donato Passarelli, Aurora, IL (US)

(73) Assignee: Fermi Research Alliance, LLC, Batavia (IL)

( * ) Notice: Subject to any disclaimer, the term of this patent is extended or adjusted under 35 U.S.C. 154(b) by 0 days.

(21) Appl. No.: 16/140,845

(22) Filed: Sep. 25, 2018

(51) Int. Cl.

| | |
|---|---|
| ***H05H 7/02*** | (2006.01) |
| ***H05H 7/22*** | (2006.01) |
| ***H05H 7/20*** | (2006.01) |
| ***H05H 7/08*** | (2006.01) |

(52) U.S. Cl.
CPC ..... *H05H 7/02* (2013.01); *H05H 7/08* (2013.01); *H05H 7/20* (2013.01); *H05H 7/22* (2013.01); *H05H 2007/025* (2013.01); *H05H 2007/225* (2013.01)

(58) Field of Classification Search
None
See application file for complete search history.

(56) References Cited

U.S. PATENT DOCUMENTS 7,746,192 B2 * 6/2010 McIntyre ..... H05H 7/18 315/505
8,324,134 B2 * 12/2012 Saito ..... H05H 7/20 148/96
8,673,820 B2 * 3/2014 Roy ..... G01R 33/1238 148/668
8,903,464 B1 * 12/2014 Myneni ..... H05H 7/20 29/599
9,023,765 B1 * 5/2015 Rimmer ..... H01J 37/32009 505/450
9,485,849 B1 * 11/2016 Vetter ..... H05H 7/22
9,527,261 B1 * 12/2016 Roper ..... F16L 41/00
9,642,239 B2 * 5/2017 Kephart ..... H05H 7/20

(Continued)

FOREIGN PATENT DOCUMENTS

WO WO-9527261 A1 * 10/1995 ..... G06T 9/008

OTHER PUBLICATIONS

J. Upadhyay, et al., "Apparatus and method for plasma processing of SRF cavities", Nuclear Instruments and Methods in Physics Research Section A: Accelerators, Spectrometers, Detectors and Associated Equipment, vol. 818, May 11, 2016, pp. 76-81.

(Continued)

*Primary Examiner* — Dion Ferguson
*Assistant Examiner* — Srinivas Sathiraju
(74) *Attorney, Agent, or Firm* — Kermit D. Lopez; Luis M. Ortiz; Ortiz & Lopez, PLLC

(57) ABSTRACT

Methods and systems for non-invasively tuning dressed multicell cavities. A multicell cavity can be plastically deformed as result of introducing a customized balloon to a cavity and then pressurizing the balloon to a targeted cell while applying a global force on the cavity flanges. The pressurized balloons localize the plastic deformation to the targeted cells using prescribed values of both global force and balloon pressure. Such an approach allows for the tuning of dressed cavities without removal of the helium vessel.

20 Claims, 13 Drawing Sheets

(56) References Cited

U.S. PATENT DOCUMENTS

| | | | | |
|---|---|---|---|---|
| 9,756,715 | B2 | 9/2017 | Biallas et al. | |
| 10,070,509 | B2 * | 9/2018 | Kephart | H05H 7/22 |
| 10,252,314 | B2 * | 4/2019 | Nohara | B21D 28/02 |
| 2002/0190670 | A1 * | 12/2002 | Pappo | H05H 7/20 315/500 |
| 2015/0020561 | A1 * | 1/2015 | Nohara | H05H 7/20 72/41 |
| 2015/0163895 | A1 * | 6/2015 | Biallas | H05H 7/20 285/18 |
| 2016/0045841 | A1 * | 2/2016 | Kaplan | B01J 19/0093 429/49 |
| 2017/0006695 | A1 * | 1/2017 | Jain | H05H 7/20 |
| 2017/0094770 | A1 * | 3/2017 | Kephart | H05H 7/20 |
| 2017/0113259 | A1 * | 4/2017 | Nohara | B21D 28/02 |
| 2017/0215268 | A1 * | 7/2017 | Myneni | H05H 7/20 |

OTHER PUBLICATIONS

"Superconducting radio frequency", https://en.wikipedia.org/wiki/Superconducting_radio_frequency, downloaded Jun. 29, 2018.

"Superconducting radio frequency," adapted from the Wikipedia entry "Superconducting radio frequency" (as of Aug. 2013).

"SRF Accelerator Research & Development", Fermi National Accelerator Laboratory, May 2016.

William Miles Soyars, "SRF cavity testing status and operating experience", AIP Conference Proceedings 1434, 1108 (2012); doi: 10.1063/1.4707031.

Perry B. Wilson, "High Energy Linacs: Applications to Storage Ring RF Systems and Linear Colliders", SLAC-PUB-2884 (Rev.), Nov. 1991.

Valery Shemelin, et al., "Systematical study on superconducting radio frequency elliptic cavity shapes applicable to future high energy accelerators and energy recovery linacs", Physical Review Accelerators and Beams, 19, 102002 (2016).

"Dressed RFD Cavities, Functional Requirements Specification", Reference : LHC-ACFDC-ES-0001, CERN, Feb. 6, 2017.

"Radiofrequency cavities", CERN, https://home.cern/about/engineering/radiofrequency-cavities, downloaded Jul. 3, 2018.

Thomas Peterson, et al., "A Survey of Pressure Vessel Code Compliance for Superconducting RF Cryomodules", FERMILAB-PUB-11-252-AD-TD.

H. Padamsee, "Design Topics for Superconducting RF Cavities and Ancillaries", https://arxiv.org/ftp/arxiv/papers/1501/1501.07129.pdf.

Robert Kephart, et al., "Compact Superconducting Radio-frequency Accelerators and Innovative RF Systems", Fermilab-Conf-15-129-DI, Apr. 10, 2015, World Innovation Conference, 2015.

C. Darve, et al., "The Superconducting Radio-Frequency Linear Accelerator Components for the European Spallation Source: First Test Results", Proceedings of LINAC2016, East Lansing, MI, USA, 2016.

* cited by examiner

RADIO FREQUENCY TUNING OF DRESSED MULTICELL CAVITIES USING PRESSURIZED BALLOONS

STATEMENT OF GOVERNMENT RIGHTS

The invention described in this patent application was made with Government support under the Fermi Research Alliance, LLC, Contract Number DE-AC02-07CH11359 awarded by the U.S. Department of Energy. The Government has certain rights in the invention.

TECHNICAL FIELD

Embodiments are generally related to SRF (Superconducting Radio Frequency) cavities utilized in linear accelerator devices and systems. Embodiments additionally relate to SRF linear accelerators that employ multicell cavities. Embodiments further relate to the use of pressurized balloons in multicell cavities in SRF applications.

BACKGROUND

Linear accelerator devices use intense radio frequency electromagnetic fields to accelerate the speed of particles to create beams used for a variety of applications. These applications include driving industrial processes, security & imaging applications, food and medical sterilization, medical treatments, isotope creation and physics research. SRF (Superconducting Radio Frequency) technology allows for the construction of linear accelerators that are both compact and efficient at using "wall plug" electrical power to create a particle beam.

SRF accelerating cavities are commonly used in linear accelerators or particle accelerators. Due to their very small RF losses, much higher acceleration efficiencies, and higher continuous wave (CW) accelerating fields than normal conducting cavities, SRF cavities are now considered the device of choice for many of today's leading applications in high energy and nuclear physics, including energy recovery linear accelerators (ERLs), linear colliders, neutrino factories, spallation neutron sources, and rare isotope accelerators. These projects place enormous demands not only on advances in beam performance, but also on more reliable and economic methods for fabrication, assembly, and operation.

Some SRF linear accelerators may employ the use of multicell cavities rather than simply a single cavity. Multicell cavities must meet certain requirements to operate properly in a particle accelerator in terms of resonance frequency, field flatness and eccentricity. Cavities are typically tuned to meet these requirements by plastic deformation. Tuning must be accomplished before welding a helium vessel to the bare cavity when there is access to the cavity's cells. Dressed cavities, however, can become detuned during the preparation, testing, and qualification process, which basically render them unusable for cryomodules assembly. Currently, a straightforward process does not exist for tuning dressed cavities other than cutting the helium vessel to access the outer surface of a cavity cell, then tune the bare cavity and dress it back. This typically has a significant impact on the cost and the schedule of large-scale particle accelerator projects, which can include, for example, hundreds of cavities.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for an improved SRF linear accelerator method and system.

It is another aspect of the disclosed embodiments to provide for a noninvasive tuning method and system capable of handling dressed cavities in an SRF linear accelerator without removing an associated helium vessel.

It is a further aspect of the disclosed embodiments to provide for an SRF linear accelerator tuning method and system that relies on plasticity deforming of a multicell cavity by introducing customized balloons and then pressurizing such balloons as targeted cells while applying a global force on the cavity flanges.

It is a further aspect of the disclosed embodiments to implement an SRF linear accelerator system in which the aforementioned pressurized balloons localize the plastic deformation to targeted cells using prescribed values of both global force and balloon pressure.

The aforementioned aspects and other objectives and advantages can now be achieved as described herein. Methods and systems are disclosed for non-invasively tuning dressed multicell cavities. In general, a multicell cavity can be plastically deformed as result of introducing a customized balloon to a cavity and then pressurizing the balloon to a targeted cell while applying a global force on the cavity flanges. The pressurized balloons localize the plastic deformation to the targeted cells using prescribed values of both global force and balloon pressure.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

Figure 1:
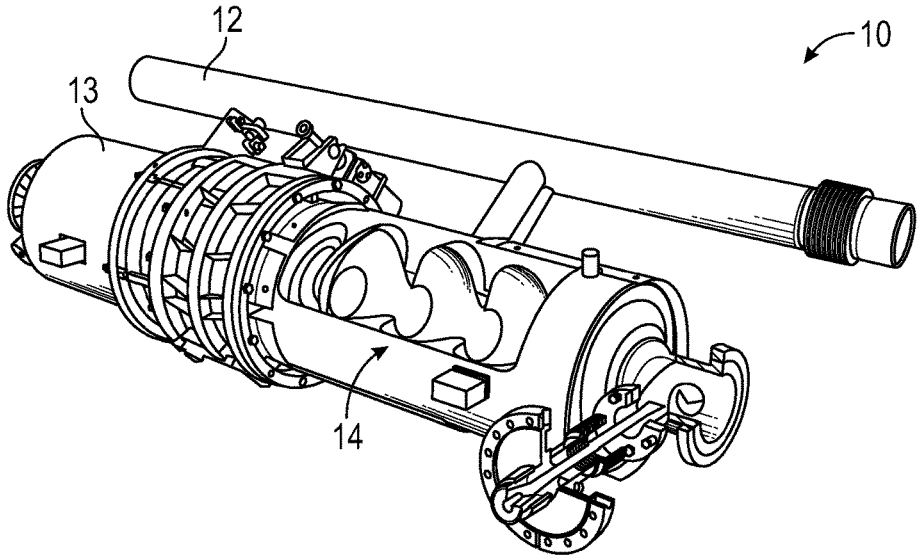
FIG. 1 illustrates a sectional cut-away view of a portion of an SRF dressed cavity (with helium vessel), which may be implemented in accordance with an example embodiment.

The particular values and configurations discussed in these non-limiting examples can be varied and are cited merely to illustrate one or more embodiments and are not intended to limit the scope thereof.

Subject matter will now be described more fully herein after with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems/devices. Accordingly, embodiments may, for example, take the form of hardware, software, firmware or any combination thereof (other than software per se). The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an example embodiment" and variations thereof as utilized herein do not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms, such as "and", "or", or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a", "an", or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context. Additionally, the term "step" can be utilized interchangeably with "instruction" or "operation".

Unless defined otherwise, all technical and scientific terms used herein have the same meanings as commonly understood by one of ordinary skill in the art. As used in this document, the term "comprising" means "including, but not limited to." The term "at least one" conveys "one or more".

FIG. 1 illustrates a sectional cut-away view of a portion of an SRF device 10, which may be implemented in accordance with an example embodiment. The SRF device 10 can be used, for example, in the context of an SRF linear accelerator, also referred to herein as a particle accelerator. The SRF device 10 generally includes a cylindrically shaped body comprising a helium vessel 13 in which one or more cavities 14 (i.e., multicell cavities) are disposed. The cylindrically shaped body of the helium vessel 13 forms the wall of the helium vessel 13, which that surrounds the cavities 14. The cavity or cavities 14 are cooled in a liquid helium bath through the helium vessel 13. Note that the helium vessel 13 is often pumped to a pressure below helium's superfluid lambda point to take advantage of the superfluid's high thermal conductivity properties. Because superfluid possesses a very high thermal conductivity, it makes an excellent coolant.

The cylindrically shaped body of the helium vessel 13 further engages with a cooling cylinder 12. Each of the cavities 14 may be composed of a metallic material that is superconducting at a cavity operating temperature. This material may constitute the entire cavity or be a coating on an inner surface of each linear accelerator cavity. In one example embodiment, each cavity of the multicell cavities 14 may comprise pure niobium. In other example embodiments, each cavity may be, but not limited to, for example, a niobium, an aluminum or a copper cavity coated in niobium-tin ($Nb_3Sn$) or other superconducting materials. The cavities are associated with one or more helium vessels. As will be discussed in greater detail herein, the disclosed embodiments allow for the non-invasive tuning of dressed cavities without removing the helium vessel(s) such as the helium vessel 13.

It should be appreciated that although the embodiments discussed herein generally involve the use of a hollow structure such as the aforementioned cavity, the disclosed embodiments are suitable for locally deforming any hollow structure that is not accessible from the outside of the cavity for one reason or another, and which is composed of multiple segments. Such a hollow structure may be a cavity, a filter, and so on.

Figure 2:
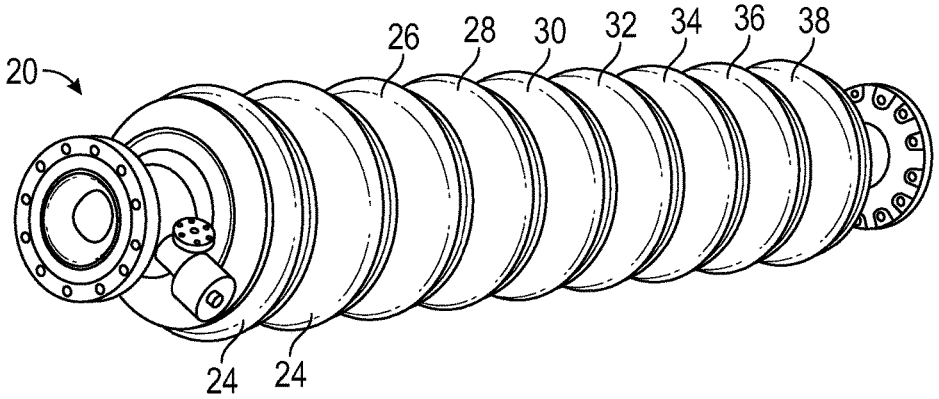
FIG. 2 illustrates a perspective view of an SRF multi-cell elliptical cavity (bare with no helium vessel) that can be implemented in a linear accelerator device such as the SRF device shown in FIG. 1, in accordance with another example embodiment.

FIG. 2 illustrates a perspective view of an SRF multicell bare elliptical cavity or device 20 that can be implemented in a linear accelerator device such as the SRF device (14) shown in FIG. 1, in accordance with another example embodiment. The SRF linear accelerator system 20 depicted in FIG. 2 includes a plurality of SRF cavities 22, 24, 26, 28, 30, 32, 34, 36, and 38, which as will be explained in greater detail herein, can temporarily host pressurized balloons located within each of the cavities 22, 24, 26, 28, 30, 32, 34, 36, and 38. Note that each cavity 22, 24, 26, 28, 30, 32, 34, 36, and 38 contains a respective cavity cell. Each cavity cell has an elliptical shape and can thus be utilized in the context of a multicell elliptical cavity arrangement.

It should be appreciated that the number of multicell cavities shown in FIGS. 1-2, for example, should not be considered a limiting feature of the present invention. Although only nine cells 22, 24, 26, 28, 30, 32, 34, 36, and 38 are shown in the particular example depicted in FIG. 2, an SRF linear accelerator system 20 may be implemented with fewer or more cells (e.g., hundreds of cavities and associated cavity cells), depending on the nature and goal of the particular accelerator project.

Note that a non-limiting example of an SRF linear accelerator system in which the disclosed embodiments can be implemented is disclosed in U.S. Patent Application Publication No. 20170094770 entitled "Compact SRF Based Accelerator," which published on Mar. 30, 2017 to Robert Kephart and is incorporated herein by reference in its entirety. It should be appreciated that the SRF linear accelerator system disclosed in non-limiting U.S. Patent Application Publication No. 20170094770 is but one example of a compact SRF based linear or particle accelerator in which the disclosed methods and systems can be utilized. The disclosed devices, systems and techniques can be implemented in the context of other types and sizes of SRF based linear or particle accelerators.

Figure 3:
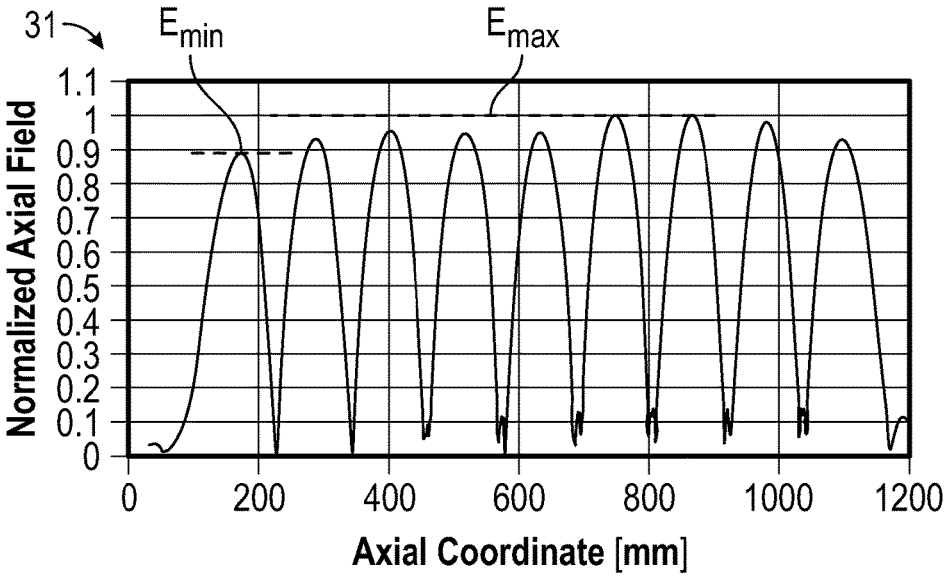
FIG. 3 illustrates a graph of FF (Field Flatness) associated with multicell cavities, in accordance with an example embodiment.
Figure 4:
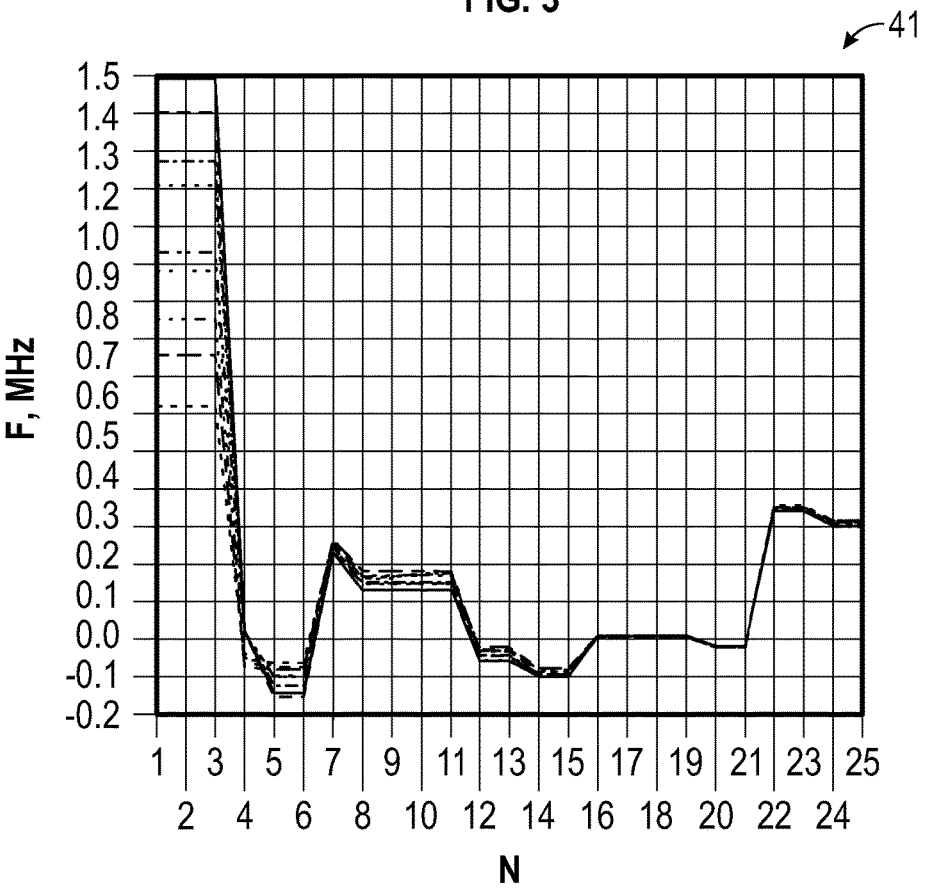
FIG. 4 illustrates a graph of resonance frequency ($f_{pi}$) associated with multicell cavities, in accordance with an example embodiment.

The graphs shown in FIGS. 3-4 generally illustrate the vitals of example multicell SRF cavities. FIG. 3 illustrates a graph 31 of FF (Field Flatness) associated with multicell cavities, in accordance with an example embodiment. Graph 31 shown in FIG. 3 plots data regarding the Normalized Field Amplitude (y-axis) versus Axial Position (x-axis) to provide an indication of FF (Field Flatness), which is a figure of merit for the uniformity of the electric field inside the cavity $FF=E_{min}/E_{max}$. For example, for FF>98%, 90% is typically required for bare and dressed cavities.

FIG. 4 illustrates a graph 41 of resonance frequency ($f_{pi}$) associated with multicell cavities, in accordance with an example embodiment. A warm cavity has to be in a certain frequency range at room temperature in order to meet a target frequency range of 2K.

Figure 5:
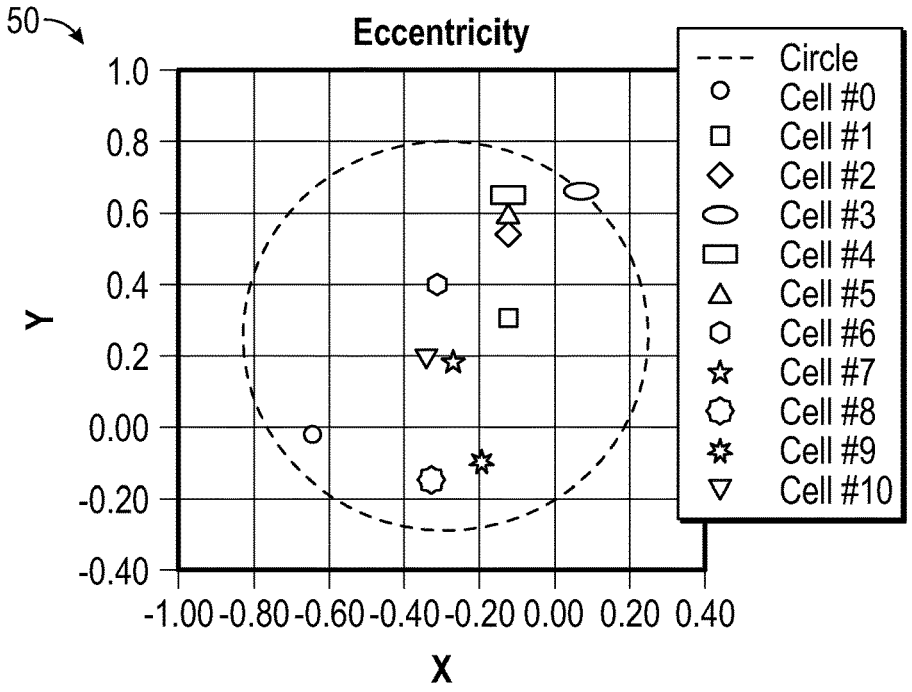
FIG. 5 illustrates a graph of Eccentricity (Ecc) associated with multicell cavities, in accordance with an example embodiment.

FIG. 5 illustrates a graph 51 of Eccentricity (Ecc) associated with multicell cavities, in accordance with an example embodiment. Ecc is a figure of merit that indicates the quality of the alignment of the various cavity cells. Ecc>0.5 mm is typically required and is considered "good".

Figure 6:
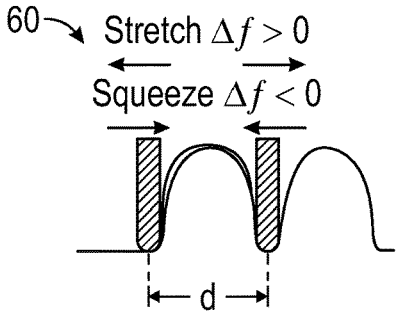
FIG. 6 illustrate a schematic diagram demonstrating how frequency and FF can be adjusted by stretching and squeezing cells beyond an elastic limit, in accordance with a conventional tuning technique.
Figure 7:
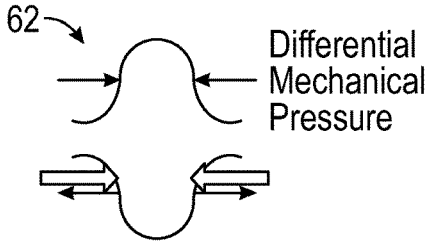
FIG. 7 illustrates a schematic diagram demonstrating how alignment can be adjusted by differential mechanical forces, in accordance with a conventional tuning technique.

FIG. 6 illustrates a schematic diagram 60 demonstrating how stretching and squeezing cells beyond an elastic limit, in accordance with a conventional tuning technique, can adjust frequency and FF. For example, stretching is indicated in the schematic diagram 60 for $\Delta f>0$ and squeezing is indicated for $\Delta f<0$. FIG. 7, on the other hand, illustrates a schematic diagram 62 demonstrating how differential mechanical forces, in accordance with a conventional tuning technique, can adjust alignment.

Figure 8A:
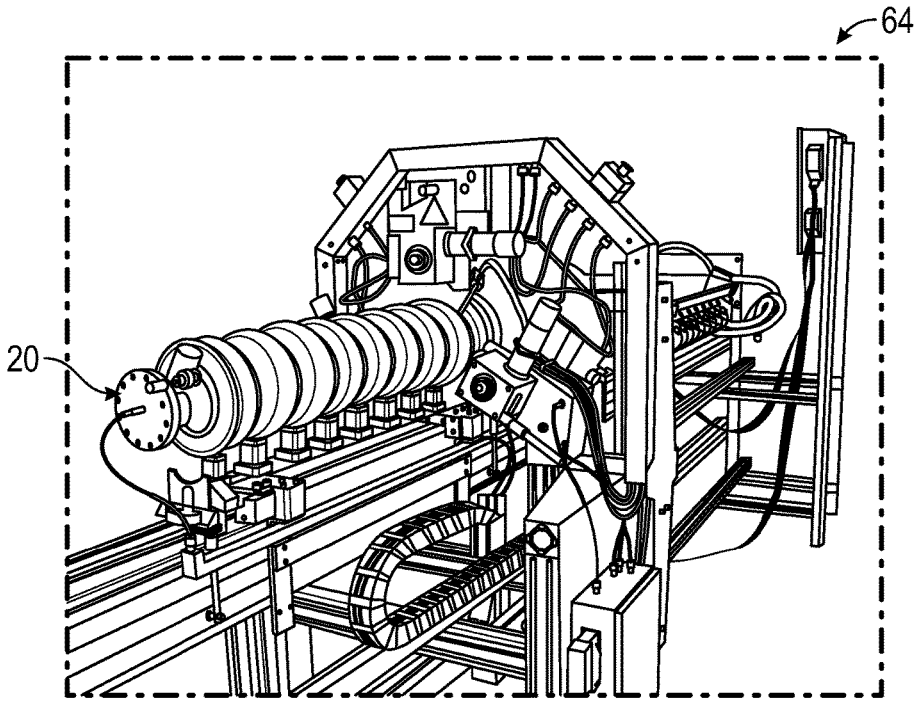
FIG. 8A illustrate an image of an SRF system involving automatic tuning for bare cavities, in accordance with a conventional tuning technique.

FIG. 8A illustrates an image of an SRF system 64 involving automatic tuning for bare cavities, in accordance with a conventional tuning technique. The example SRF system 64 shown in FIG. 8 generally includes an SRF multicell cavity or apparatus such as the device 20 discussed previously. The configuration or set up shown in the image depicted in FIG. 8A generally involves automatic tuning for bare cavities (without the balloon(s) implementations discussed herein).

Figure 8B:
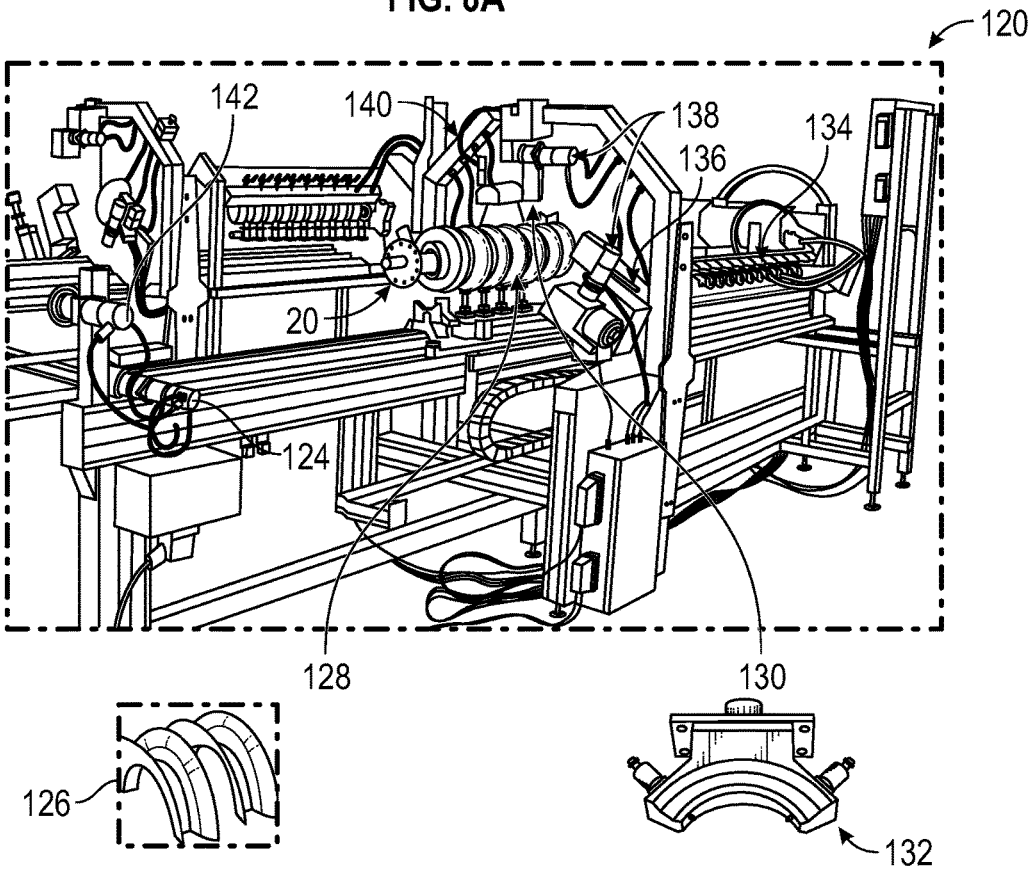
FIG. 8B illustrates an image of a cavity tuning system, also in accordance with a conventional tuning technique.

FIG. 8B illustrates an image of a cavity tuning system 120, also in accordance with a conventional tuning technique. The cavity tuning system 120 shown in FIG. 8B generally includes conventional tuning and includes the SRF accelerator device 20 with its various cavities, as shown centrally in the image of FIG. 8B. The system 120 includes a tuning frame 140 with three independent jaws along with a jaws motor 138. Jaws linear actuator (×3) 136 is also provided in addition to an eccentricity measurement system 134. Tuning jaws (×6) 132 and protective shields such as a protective shield 128 are also provided. A protective shield is provided with respect to each cavity for a total of, for example, 10 protective shields. The system 120 further includes a base motor frame 124 and a bead pull motor 142.

Figure 9:
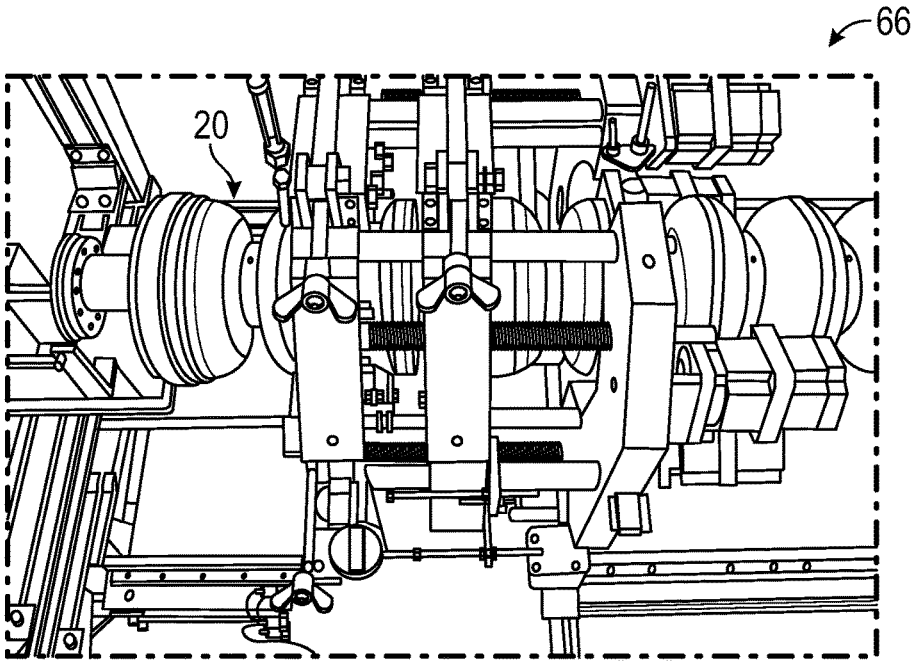
FIG. 9 illustrates an image of an SRF system involving manual tuning for bare cavities, in accordance with a conventional tuning technique.

FIG. 9 illustrates an image of an SRF system 66 involving manual tuning for bare cavities, in accordance with a conventional tuning technique. The SRF system 66 shown in FIG. 9 can also employ an SRF multicell cavity or apparatus such as the device 20 discussed previously. FIGS. 8A-8B and FIG. 9 thus generally demonstrate tuning with respect to cavities without the disclosed balloon implementations.

Figure 10:
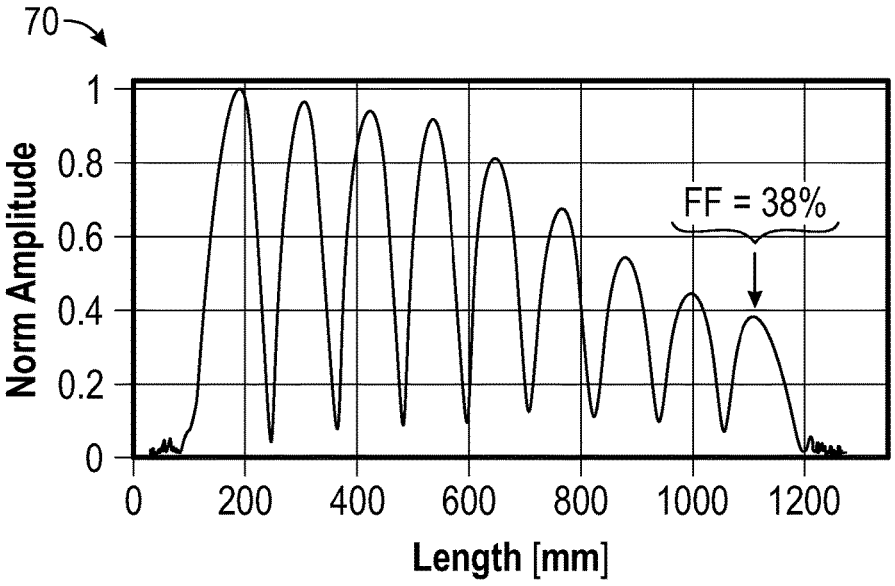
FIG. 10 illustrates a graph depicting data indicative of a dressed cavity that became accidentally deformed.

FIG. 10 illustrates a graph 70 depicting data indicative of a dressed cavity that became accidentally deformed during the long qualification and testing process. In graph 70, normalized amplitude (y-axis) is plotted versus length (x-axis) in mm.

Dressed cavities can become accidentally deformed during the aforementioned qualification and testing process. As discussed previously herein, there currently does not exist a straightforward device and/or a technique that effectively tunes dressed cavities other than cutting the vessel and then tuning the bare cavity and dressing it back. This conventional approach typically has a significant impact on cost and schedule.

The graph 70 shown in FIG. 10 is an example of a dressed cavity that "went bad". The disclosed balloon device and related techniques were thus developed by the present inventors to address this problem. Note that as utilized herein, the terms "dressed cavities" or "dressed cavity" generally refers to an integrated assembly wherein a niobium cavity has been permanently joined to a cryogenic containment vessel, such that the cavity is surrounded by cryogenic liquid during operation.

Figure 11:
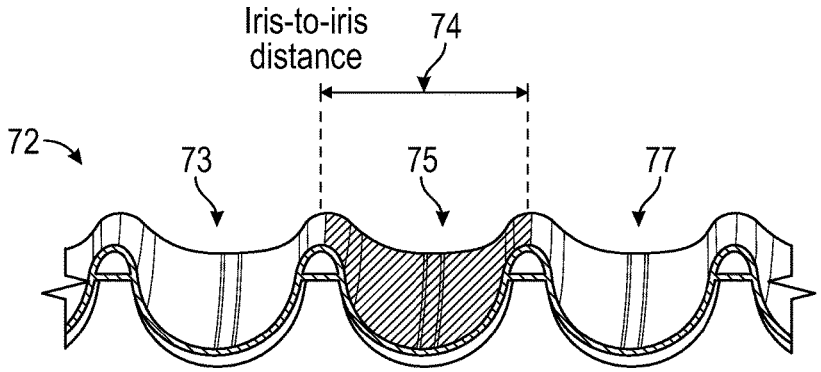
FIG. 11 illustrates a cut-away view of a multicell arrangement including the iris-to-iris distance, in accordance with an example embodiment.
Figure 12:
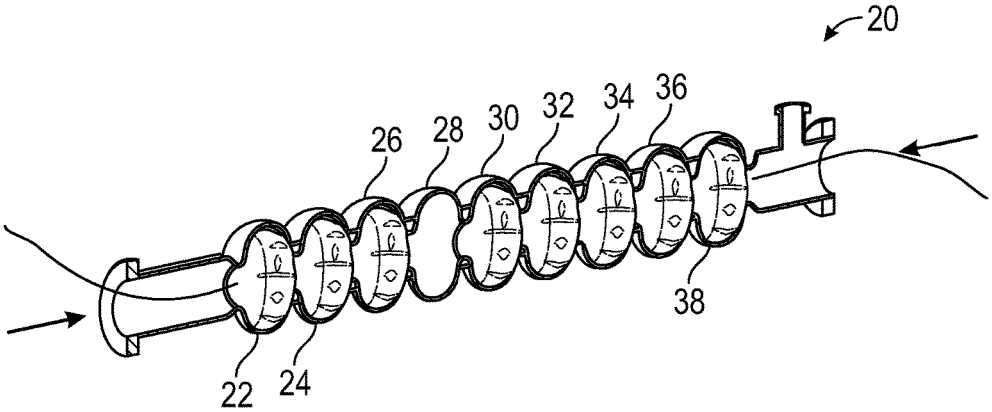
FIG. 12 illustrates a schematic diagram of a multicell linear accelerator with cell compression identified, in accordance with an example embodiment.

FIG. 11 illustrates a cut-away view of a multicell arrangement 72 including an example of iris-to-iris distance 74, in accordance with an example embodiment. In FIG. 11, three example cells 73, 75 and 77 are shown (or at least a portion of such cells). FIG. 12 illustrates a schematic diagram of a multicell cavity 20 with cell compression identified, in accordance with an example embodiment. Balloons to be inserted in the marked cells. In FIG. 12 areas of lower stress (marked cells) and high stress are indicated along with global force during cell compression.

Figure 13:
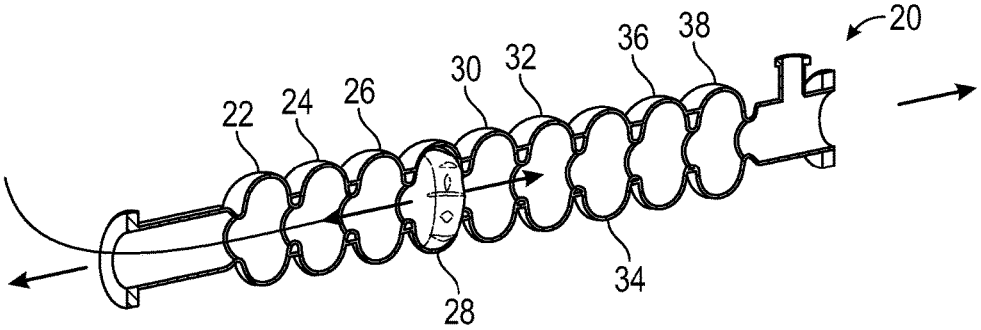
FIG. 13 illustrates a schematic diagram of a multicell linear accelerator with cell expansion identified, in accordance with an example embodiment.

FIG. 13 illustrates a schematic diagram of the multicell cavity 20 with cell expansion identified, in accordance with an example embodiment. Balloons to be inserted in the marked cell. In FIG. 13, a higher stress area (marked cell) is indicated and a lower stress area is shown in addition to the global force and local pressure force.

The basic concept behind the disclosed embodiments is thus to use pressurized balloons from cavity's inside surface to apply forces on targeted cells and localize plastic deformation. The target cell thus gets plastically deformed and the other cells remain in the linear elastic region because of lower stresses.

Figure 14:
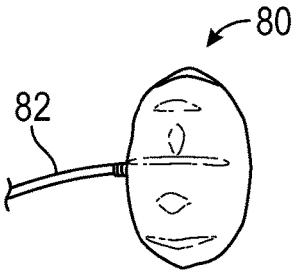
FIG. 14 illustrates an image of a balloon configured from rubberized nylon, in accordance with an example embodiment.

FIG. 14 illustrates a sketch of a balloon 80 configured from rubberized nylon, in accordance with an example embodiment. A rod or hose 82 is connected to the balloon 80 as shown in FIG. 14. It should be appreciated that although the balloon 80 can be configured from a rubberized nylon material, it can be appreciated the balloon 80 may be configured from other types of materials. In other words, the use of rubber for balloon 80 is not a limiting feature of the disclosed embodiments. In other embodiments, other types of materials may be utilized in place of rubber to configure the balloon 80. Reference is made to rubber herein only for illustrative and exemplary purposes only.

Figure 15:
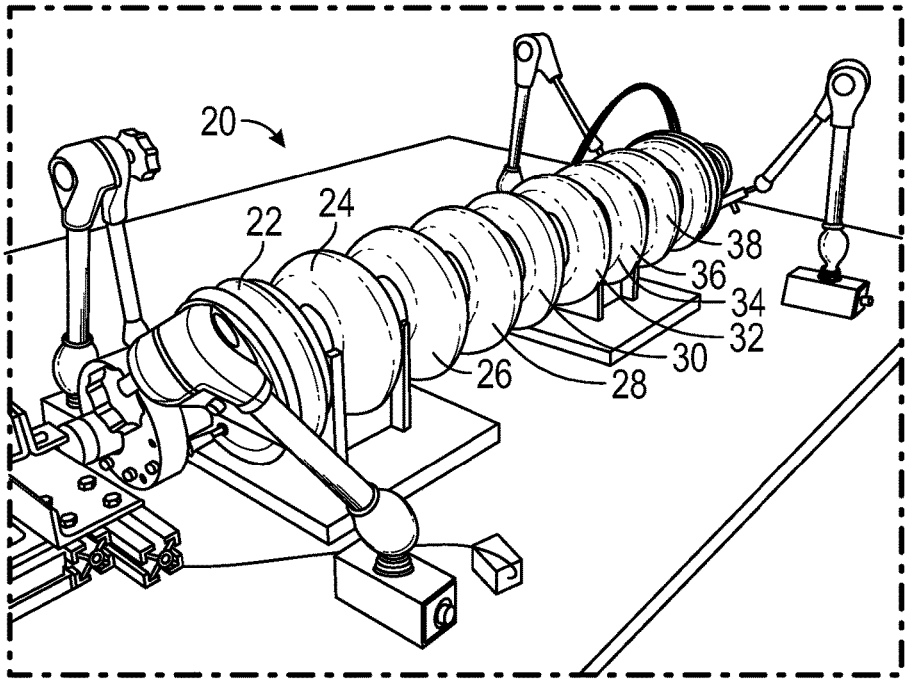
FIG. 15 illustrate an image of an SRF accelerator device including multicell cavities filled with pressurized balloons such as the balloon shown in FIG. 14, in accordance with an example embodiment.
Figure 16:
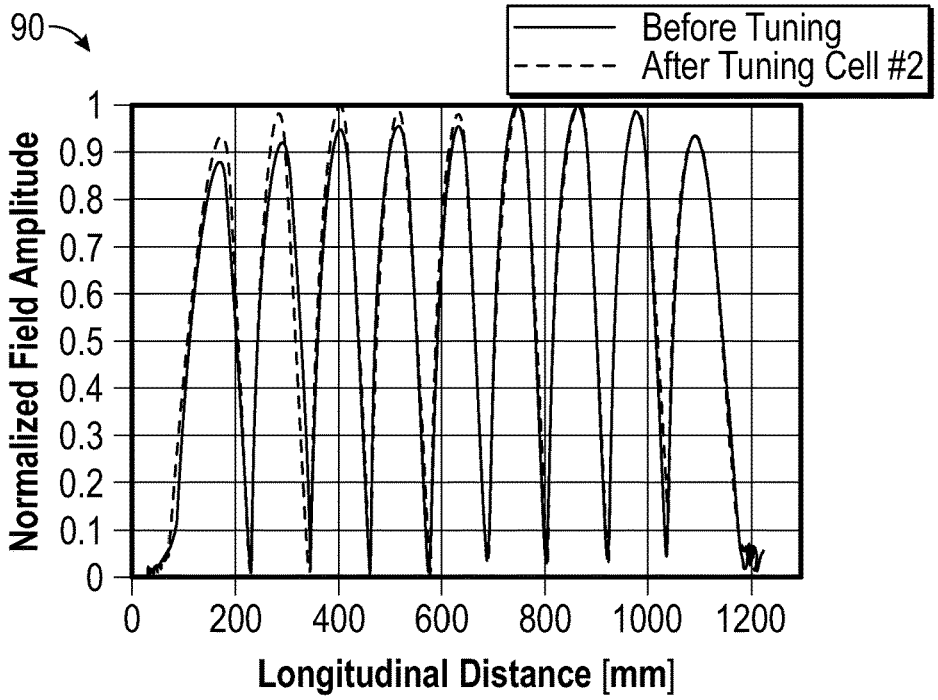
FIG. 16 illustrate a graph demonstrating normalized field amplitude (y-axis) versus longitudinal distance (x-axis) before tuning and after tuning, in accordance with an example embodiment.

FIG. 15 illustrate an image of an SRF accelerator device 20 including multicell cavities 22, 24, 26, 28, 30, 32, 34, 36, and 38 filled with pressurized balloons such as the balloon shown in FIG. 14, in accordance with an example embodiment. The arrangement shown in FIG. 15 was used to demonstrate the disclosed balloon tuning technique initially on a bare cavity (e.g. cell #2). The graph 90 shown in FIG. 16 demonstrates normalized field amplitude (y-axis) versus longitudinal distance (x-axis) before tuning and after tuning, in accordance with an example embodiment. The data thus shows an approximately 92.5% field flatness after balloon tuning demonstrating success in the use of pressurized balloons.

Figure 17:
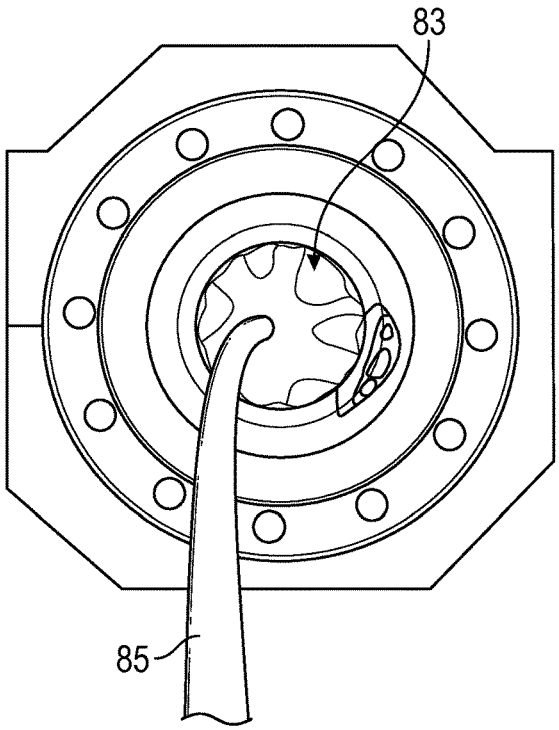
FIG. 17 illustrates an image of a balloon located in a cavity, in accordance with an example embodiment.

FIG. 17 illustrates an image of a balloon 83 located inside a cavity, in accordance with an example embodiment. A tube 85 connects to the balloon 83 and is shown protruding from the cavity.

Figure 18:
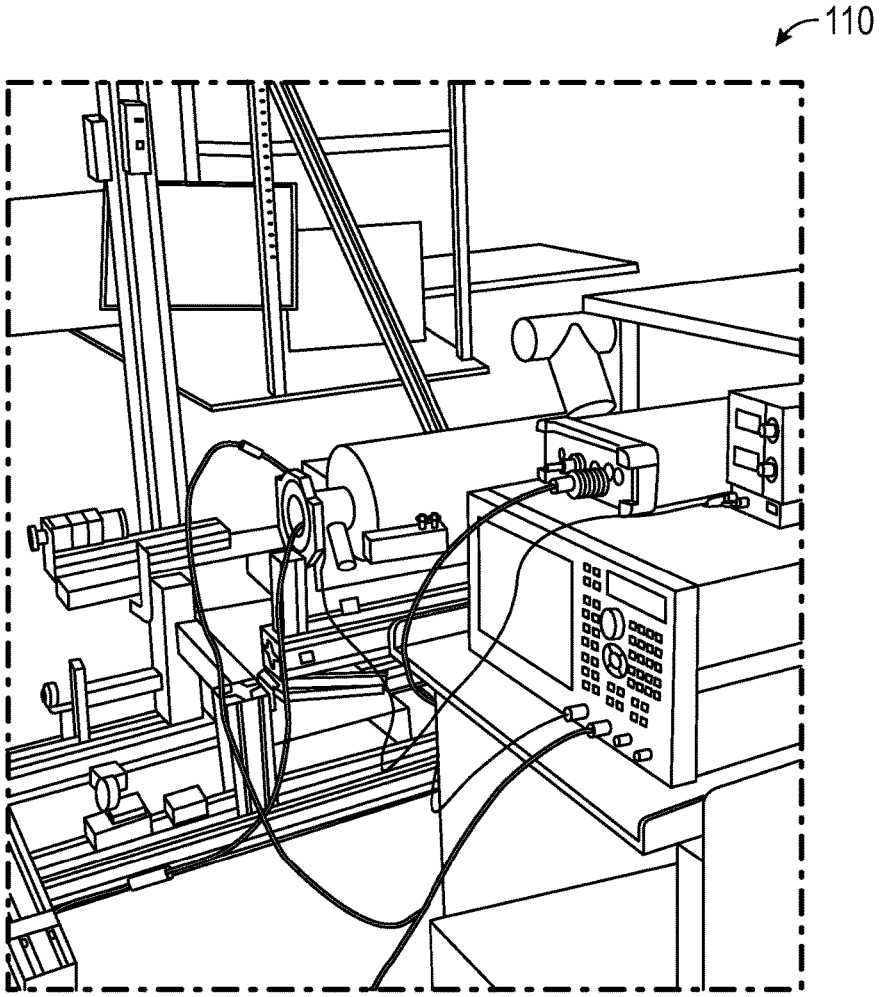
FIG. 18 illustrates an image of a balloon tuning set-up, in accordance with an example embodiment.

FIG. 18 illustrates an image of an example balloon-tuning set-up 110, in accordance with an example embodiment. It should be appreciated that the image shown in FIG. 18 is a laboratory set up only and that variations to this depicted arrangement are likely. The particular arrangement shown in FIG. 18 and elsewhere herein is not a limiting feature of the disclosed embodiments.

Figure 19:
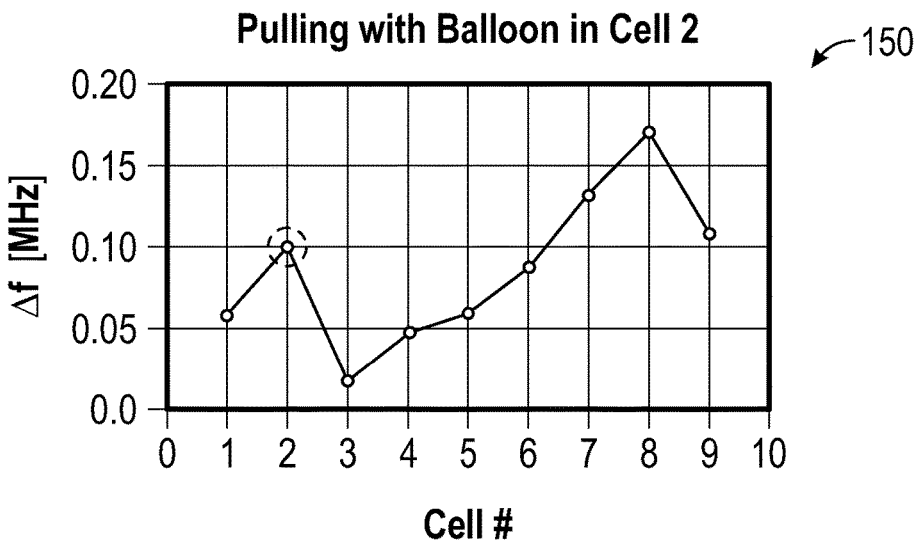
FIG. 19 illustrates a graph of maximized frequency change, in accordance with an example embodiment.

FIG. 19 illustrates a graph 150 of maximized frequency change, in accordance with an example embodiment. The graph 150 shown in FIG. 19 plots the cell number (x-axis) versus the change in frequency (y-axis). Pulling with the balloon in cell 2 is demonstrated by the data plotted in graph 150.

Figure 20:
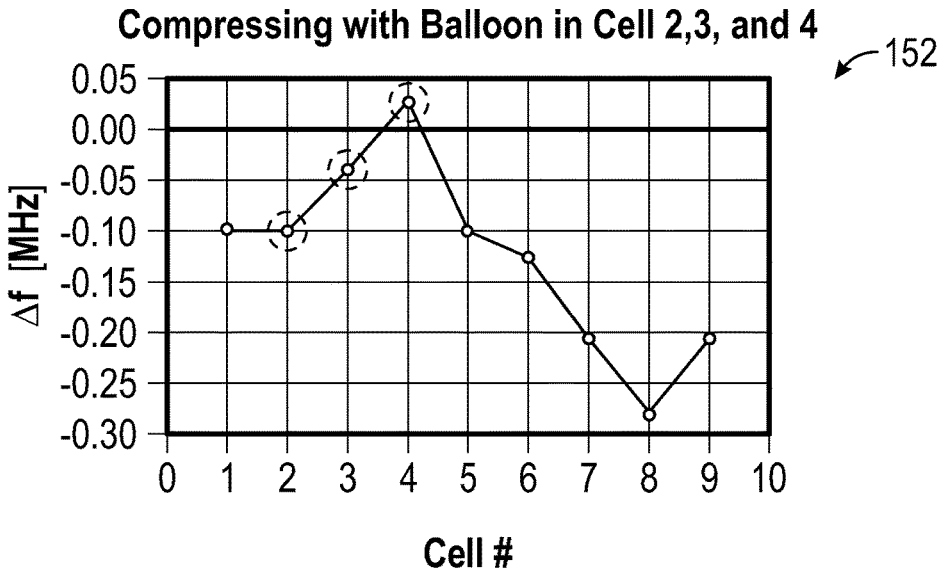
FIG. 20 illustrates a graph of minimized frequency change, in accordance with an example embodiment.

FIG. 20 illustrates a graph 152 of minimized frequency change, in accordance with an example embodiment. The graph 152 shown in FIG. 20 also plots the cell number (x-axis) versus the change in frequency (y-axis). Compressing with the balloon in cell 2, 3, and 4 is demonstrated graph 152.

Figure 21:
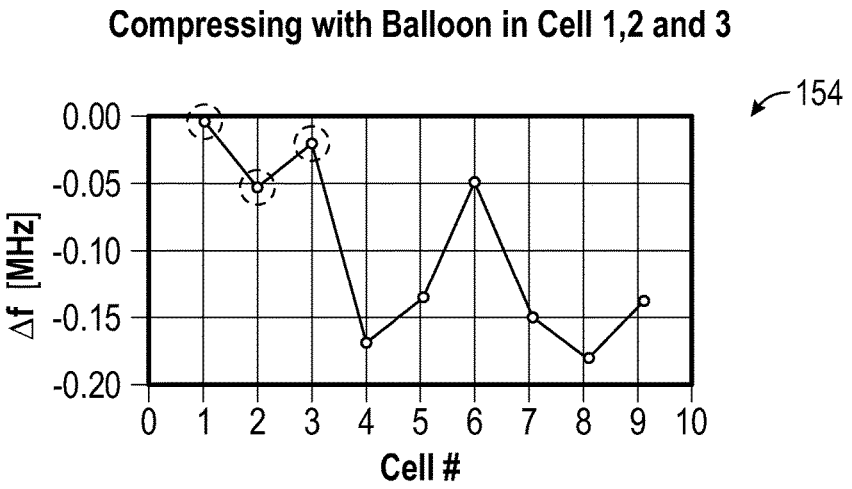
FIG. 21 illustrates a graph of frequency changes of cell frequencies, in accordance with an example embodiment.

FIG. 21 illustrates a graph 154 of frequency changes of cell frequencies, in accordance with an example embodiment. The data plotted as shown in FIGS. 19, 20 and 21 illustrate the results of balloon tuning with respect to a dressed cavity (e.g., TB9AES018). The graphs include data regarding the calculated frequency per cell, and further demonstrate initially pulling (but cell #8 was softer than the others), following by compression. In addition, these plots demonstrate frequency changes of cell frequencies, which indicates that that the use of pressurized balloons as discussed herein effectively induces the desired effect on targeted cells.

Figure 22:
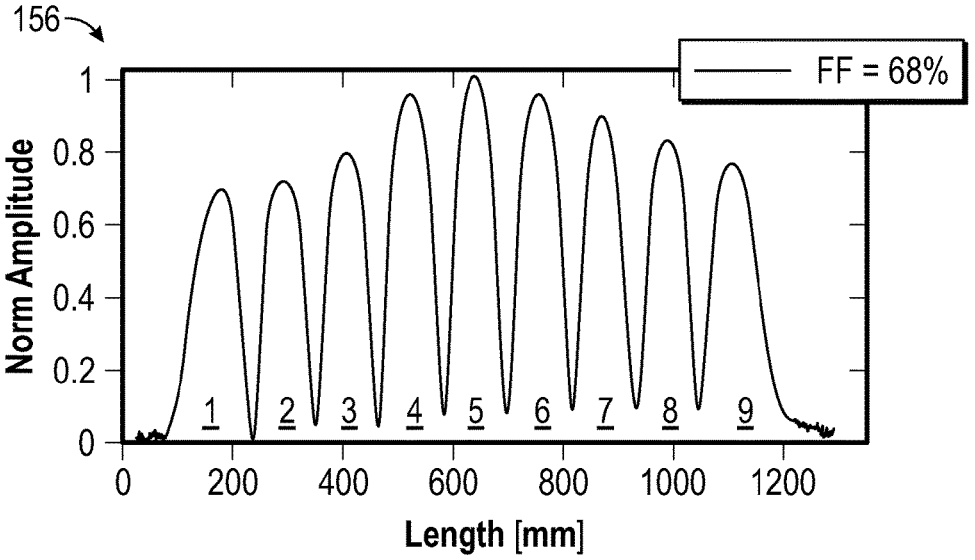
FIG. 22 illustrates a graph of data for the disclosed balloon turning technique applied to SRF cavities, in accordance with an example embodiment.

FIG. 22 illustrates a graph 156 of data for the disclosed balloon turning technique applied to SRF cavities, in accordance with an example embodiment. The sample graph 156 plots data collected as a result of a TB9-AES018 tuning procedure and plots norm amplitude (x-axis) versus length (y-axis). Initial conditions were $f_0$=1298.120 MHz and FF=0.68. The target frequency and FF are $f_0$=1297.95 MHz and FF≥0.9. The LCLS-11 specifications are FF>90% and $1297.91<f_0<1298.120$ MHz.

Figure 23:
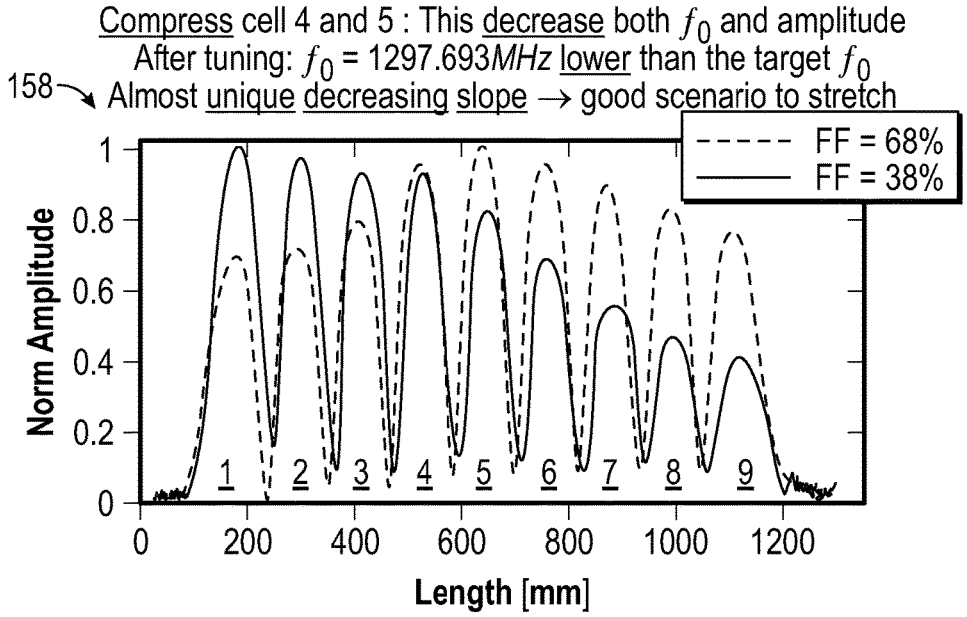
FIG. 23 illustrates a graph of data for the disclosed balloon turning technique applied to SRF cavities, in accordance with another example embodiment.
Figure 24:
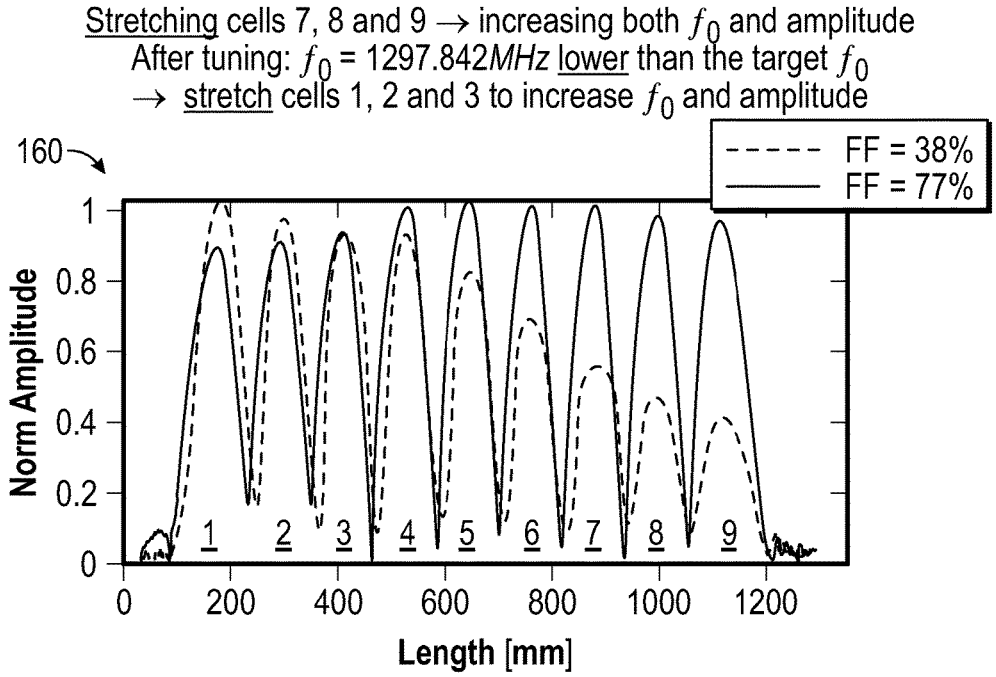
FIG. 24 illustrates a graph of data for the disclosed balloon turning technique applied to SRF cavities, in accordance with yet another example embodiment.
Figure 25:
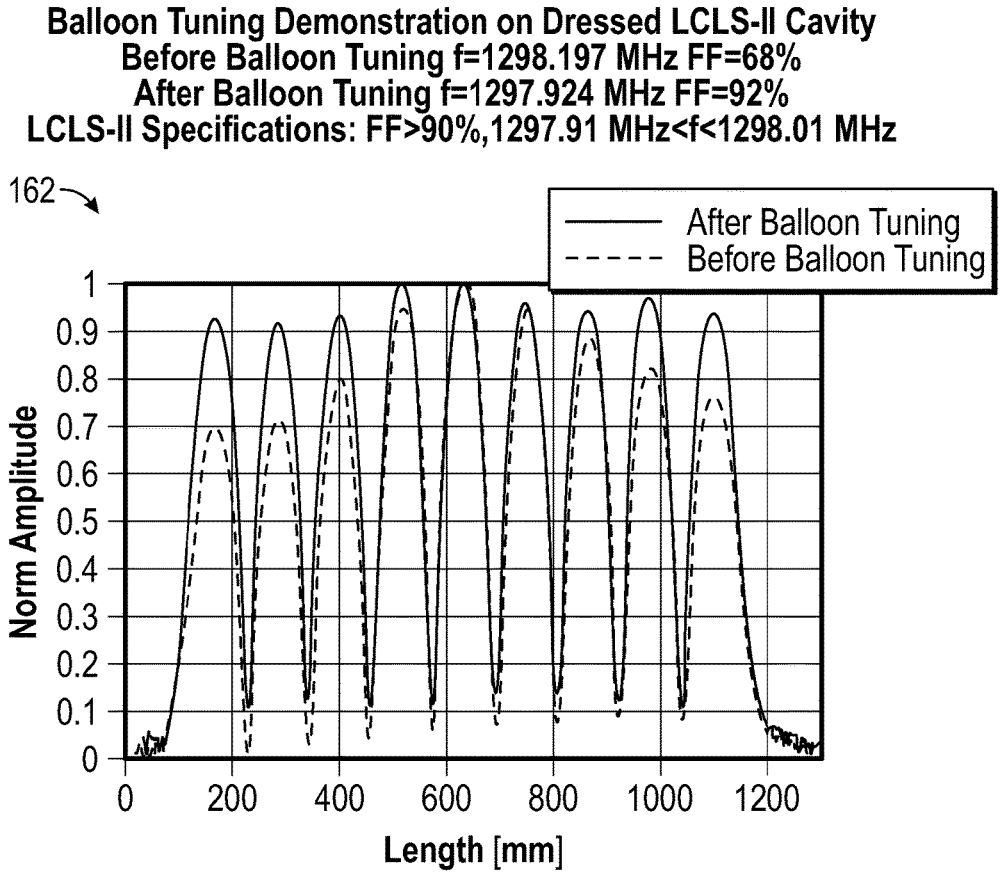
FIG. 25 illustrates a graph depicting data indicative of balloon tuning, in accordance with an example embodiment.

FIGS. 23, 24, and 25 respectively illustrate graphs 158, 160, and 162, which plot data collected as result of the disclosed balloon turning technique applied to SRF cavities, in accordance with varying experimental embodiments. FIG. 23 relates to compression with respect to cells #4 and #5. FIG. 24 relates to stretching cells #7, #8, and #9.

FIG. 25 illustrates a graph 162 depicting data indicative of balloon tuning, in accordance with another example embodiment. The graph 162 demonstrates the following parameters: Before Balloon Tuning f=1298.197 MHz FF=68%; and After Balloon Tuning f=1297.924 MHz FF=92%. This data represents successful results from an experimental embodiment of the disclosed approach with respect to a dressed cavity. The resonant frequency (f) and field flatness (FF) meet, for example the LCLS-II specifications (i.e., Linac Coherent Light Source—an approximately one billion dollar accelerator project for which the cavity was built).

It can be appreciated that the disclosed balloon technique has been implemented to successfully bring an LCLS-II multicell elliptical cavity back to specification after being accidentally detuned during a pressure test. The cavity was also qualified after balloon tuning with no degradation in quality factor and gradient, proving that the used balloon material can be cleaned with residuals on the inner cavity surface.

Based on the foregoing, it can be appreciated that a number of example embodiments (both preferred and alternative embodiments) are disclosed herein. In a preferred embodiment, for example, a system for radio frequency tuning of hollow structures can be configured to include at least one pressurized balloon located in at least one targeted cell of a hollow structure of a device having a plurality of hollow structures and a plurality of respective cells. The at least one pressurized balloon is targeted to the at least one targeted cell so as to localize plastic deformation to the at least one targeted cell using prescribed values of global force and balloon pressure with respect to the at least one pressurized balloon, thereby facilitating a noninvasive tuning of the at least one targeted cell of the hollow structure.

In some example embodiments, the aforementioned device can be implemented as or in the context of an SRF (Superconducting Radio Frequency) cavity for use in a particle accelerator.

In still other example embodiments, the aforementioned pressurized balloon can be configured as a rubberized/nylon balloon. Such a pressurized balloon can be pressurized after being introduced to the targeted cell of the hollow structure. The targeted cell is plastically deformed while other cells remain in an elastic region because of a lower stress. The hollow structure generally comprises a cavity. In some example embodiments, this cavity can be composed of a multicell elliptical cavity among a plurality of adjacent cavities.

In other example embodiments, this cavity may be configured as a dressed multicell cavity among a plurality of adjacent cavities. In still other example embodiments, the hollow structure can be configured as a filter.

In still another example embodiment, a system for radio frequency tuning of hollow structures, can be configured, which includes at least one pressurized balloon located in at least one targeted cell of a hollow structure of a device comprising an SRF cavity for use in a particle accelerator and having a plurality of hollow structures and a plurality of respective cells, wherein the at least one pressurized balloon is targeted to the at least one targeted cell so as to localize plastic deformation to the at least one targeted cell using prescribed values of global force and balloon pressure with respect to the at least one pressurized balloon, thereby facilitating a noninvasive tuning of the at least one targeted cell of the hollow structure.

In yet another example embodiment, a method for radio frequency tuning of hollow structures can be implemented. Such a method can include, for example, steps, operations or instructions, such as locating one or more pressurized balloons in one or more targeted cells of a hollow structure of a device having a group of hollow structures and a group of respective cells; and targeting the one or more pressurized balloons to one or more of the targeted cell so as to localize plastic deformation to the targeted cell(s) using prescribed values of global force and balloon pressure with respect to the one or more pressurized balloons, thereby facilitating a noninvasive tuning of the targeted cell(s) of the hollow structure.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A system for radio frequency tuning of hollow structures, said system comprising:

at least one pressurized balloon located in at least one targeted cell of a hollow structure of a device having a plurality of hollow structures and a plurality of respective cells, wherein said at least one pressurized balloon is targeted to said at least one targeted cell so as to localize plastic deformation to said at least one targeted cell using prescribed values of global force and balloon pressure with respect to said at least one pressurized balloon, thereby facilitating a noninvasive tuning of said at least one targeted cell of said hollow structure.

2. The system of claim 1 wherein said device comprises an SRF (Superconducting Radio Frequency) cavity for use in a particle accelerator.

3. The system of claim 1 wherein said at least one pressurized balloon comprises a rubberized/nylon balloon.

4. The system of claim 1 wherein said at least one pressurized balloon is pressurized after being introduced to said at least one targeted cell of said hollow structure.

5. The system of claim 1 wherein said at least one targeted cell is plastically deformed while other cells remain in an elastic region because of a lower stress.

6. The system of claim 1 wherein said hollow structure comprises a cavity.

7. The system of claim 6 wherein said cavity comprises a multicell elliptical cavity among a plurality of adjacent cavities.

8. The system of claim 6 wherein said cavity comprises a dressed multicell cavity among a plurality of adjacent cavities.

9. The system of claim 1 wherein said hollow structure comprises a filter.

10. A system for radio frequency tuning of hollow structures, said system comprising:

at least one pressurized balloon located in at least one targeted cell of a hollow structure of a device comprising an SRF cavity for use in a particle accelerator and having a plurality of hollow structures and a plurality of respective cells, wherein said at least one pressurized balloon is targeted to said at least one targeted cell so as to localize plastic deformation to said at least one targeted cell using prescribed values of global force and balloon pressure with respect to said at least one pressurized balloon, thereby facilitating a noninvasive tuning of said at least one targeted cell of said hollow structure.

11. The system of claim 10 wherein said at least one pressurized balloon comprises a rubberized/nylon balloon.

12. The system of claim 10 wherein said at least one pressurized balloon is pressurized after being introduced to said at least one targeted cell of said hollow structure.

13. The system of claim 10 wherein said at least one targeted cell is plastically deformed while other cells remain in an elastic region because of a lower stress.

14. The system of claim 10 wherein said hollow structure comprises a cavity.

15. The system of claim 14 wherein said cavity comprises a multicell elliptical cavity among a plurality of adjacent cavities.

16. The system of claim 14 wherein said cavity comprises a dressed multicell cavity among a plurality of adjacent cavities.

17. The system of claim 10 wherein said hollow structure comprises a filter.

18. A method for radio frequency tuning of hollow structures, said method comprising:

locating at least one pressurized balloon in at least one targeted cell of a hollow structure of a device having a plurality of hollow structures and a plurality of respective cells; and targeting said at least one pressurized balloon to said at least one targeted cell so as to localize plastic deformation to said at least one targeted cell using prescribed values of global force and balloon pressure with respect to said at least one pressurized balloon, thereby facilitating a noninvasive tuning of said at least one targeted cell of said hollow structure.

19. The method of claim 18 wherein said device comprises an SRF (Superconducting Radio Frequency) cavity for use in a particle accelerator and wherein said at least one pressurized balloon comprises a rubberized/nylon balloon.

20. The method of claim 18 further comprising pressurizing said at least one pressurized balloon after being introduced to said at least one targeted cell of said hollow structure.

* * * * *